US006863619B2

(12) United States Patent
Blacklock

(10) Patent No.: US 6,863,619 B2
(45) Date of Patent: Mar. 8, 2005

(54) GOLF TRAINING APPARATUS

(75) Inventor: Luther Blacklock, Beds (GB)

(73) Assignee: Explanar (Holdings) Limited (GB)

( * ) Notice: Subject to any disclaimer, the term of this patent is extended or adjusted under 35 U.S.C. 154(b) by 47 days.

(21) Appl. No.: 10/257,468

(22) PCT Filed: Apr. 17, 2001

(86) PCT No.: PCT/GB01/01713

§ 371 (c)(1),
(2), (4) Date: Apr. 2, 2003

(87) PCT Pub. No.: WO01/78849

PCT Pub. Date: Oct. 25, 2001

(65) Prior Publication Data

US 2003/0162600 A1 Aug. 28, 2003

(30) Foreign Application Priority Data

Apr. 17, 2000 (GB) ..... 0009499

(51) Int. Cl.[7] ..... A63B 69/36
(52) U.S. Cl. ..... 473/259
(58) Field of Search ..... 473/257, 258, 473/259, 260, 219

(56) References Cited

U.S. PATENT DOCUMENTS

| | | | | | |
|---|---|---|---|---|---|
| 3,339,927 | A | | 9/1967 | Nunn | |
| 3,341,208 | A | | 9/1967 | Marcella | |
| 3,489,416 | A | * | 1/1970 | Mark | 473/229 |
| 3,744,799 | A | * | 7/1973 | Hightower | 473/259 |
| 3,917,281 | A | * | 11/1975 | Oppenheimer | 473/229 |
| 4,040,633 | A | | 8/1977 | Sciarrillo | |
| 4,576,378 | A | | 3/1986 | Backus | |
| 4,583,740 | A | * | 4/1986 | Ohly | 473/259 |
| 5,429,367 | A | | 7/1995 | Amos | |
| 5,439,225 | A | * | 8/1995 | Gvoich et al. | 473/223 |
| 5,595,545 | A | | 1/1997 | O'Brien | |
| 5,816,932 | A | * | 10/1998 | Alexander | 473/259 |
| 5,984,798 | A | | 11/1999 | Gilmour | |
| 6,027,414 | A | | 2/2000 | Koebler | |
| 2003/0162600 | A1 | * | 8/2003 | Blacklock | 473/259 |

FOREIGN PATENT DOCUMENTS

| | | |
|---|---|---|
| EP | 0 057 467 | 8/1982 |
| EP | 0 816 123 | 1/1998 |
| GB | 227725 | 1/1925 |
| GB | 2 253 357 | 9/1992 |
| GB | 2 280 118 | 1/1995 |
| WO | WO 83/02728 | 8/1983 |

OTHER PUBLICATIONS

UK Search Report for GB 0009499.5 dated Jul. 11, 2000.

* cited by examiner

*Primary Examiner*—Raleigh W. Chiu
(74) *Attorney, Agent, or Firm*—Cantor Colburn LLP

(57) ABSTRACT

A golf training aid includes a circular hoop that is inclined or inclinable in use at an angle to the horizontal. A planar surface is defined extending outwardly from a surface of an upper end of the hoop and parallel to the plane of the hoop. The golf training aid can be used in combination with a club and can assist a golfer in developing an improved swing.

27 Claims, 6 Drawing Sheets

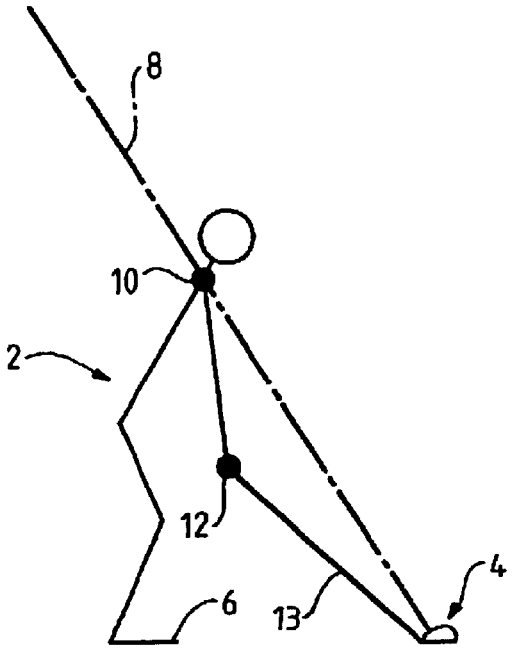
FIG. 1
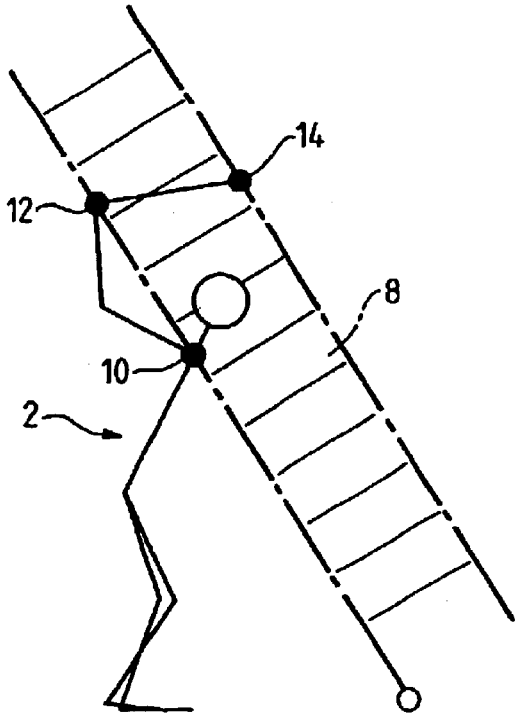
FIG. 2
FIG. 3
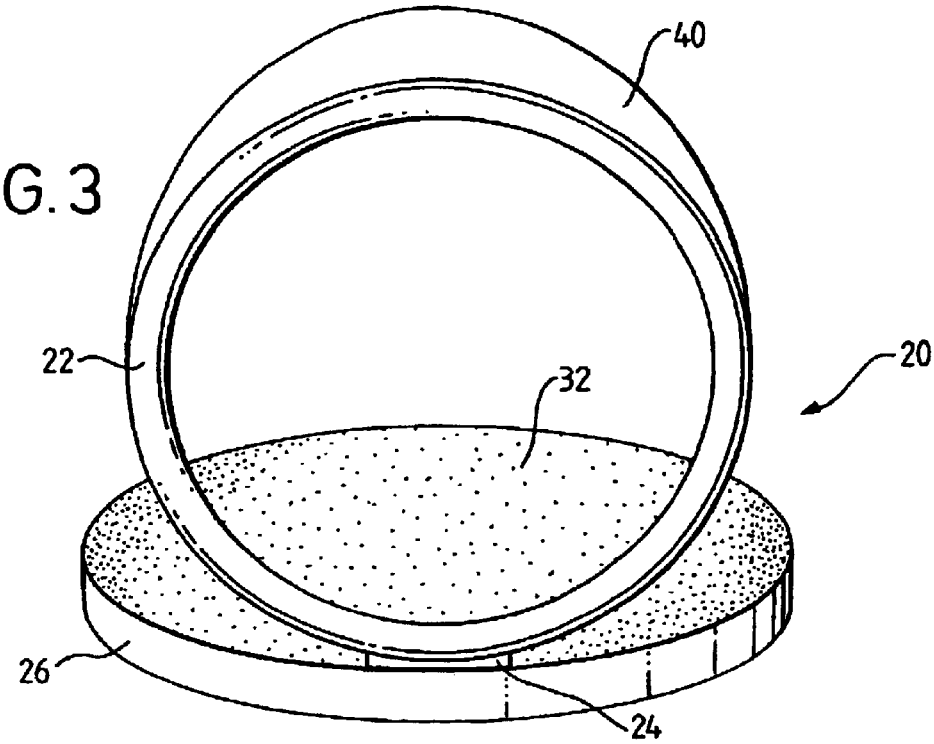

GOLF TRAINING APPARATUS

The present invention relates to golf training apparatus and more particularly to apparatus which can assist a golfer in developing an improved swing.

The swing is undoubtedly one of, if not the, most important component of a golfer's game. It is a complex composite movement of a golfer's hands, wrists, arms and body and if not properly executed can lead to a ball being mishit.

Most golfers practice their swing in an empirical manner, for example by hitting practice balls on a driving range. Developing a swing in this manner is rather unsatisfactory since the golfer will not necessarily know why he or she has mishit a ball and so be able to correct the fault. Also, there is no easy way in which, having hit a ball successfully, the golfer can reliably repeat that shot.

One training aid has been proposed which takes the form of an inclined hoop inside which a golfer stands. The golfer rests his or her club on the hoop and then swings the club in contact with the hoop. As the club is swung, it is constrained to move in a given plane by the hoop, at least at its point of contact with the hoop. This may go some way to improving the swing in that it allows the golfer easily to reproduce a given swing, but it does not provide a fully satisfactory training aid in that it fails to address a particularly important area of the swing, namely the top of the backswing.

The Applicant has recognised that the optimum swing is achieved when the swing occurs in an optimum swing plane. This plane is a plane which extends generally through the upper sternum of the golfer to the ball at the point of striking the ball. In particular, the Applicant has recognised that the ball, the golfer's upper sternum, the butt of the club and the "sweet spot" of the club head (that part of the club head which will make optimum contact with the ball) should all lie in the optimum plane at the top of the backswing and also in the follow through. Whilst the above described hoop apparatus may to some extent assist a golfer in developing a swing, it does not constrain the swing at the top of the backswing or in the follow through since the shaft of the club may rotate around the contact surface of the hoop such that the head and butt of the club may lie out of the optimum swing plane.

The present invention seeks to overcome this problem and from a first aspect the invention provides a golf training aid comprising a circular hoop inclined or inclinable in use at an angle to the horizontal, and means defining a planar surface extending outwardly from the surface of the upper end of the hoop in a direction parallel to the plane of the hoop.

In accordance with the invention therefore, a planar surface is defined around the upper end of the hoop in a direction parallel to the plane of the hoop. The planar surface acts to guide the club along the optimum swing plane more accurately than in existing apparatus, preventing unwanted rotation of the club around the hoop at the top part of the backswing. From a further broad aspect, therefore the invention provides a golf training aid comprising a hoop inclined or inclinable in use at an angle to the horizontal and over whose surface a club may be swung, said hoop comprising means which guides the club to move in a given plane at the top of the swing.

The planar surface extends only over a limited circumferential extent of the hoop. This is because the surface is actually only needed at the top of the hoop, since certain excursions of the club from the optimum swing plane can be tolerated in the lower parts of the swing. Indeed this is desirable in that it allows a golfer to develop a more natural swing.

Typically, therefore, the planar surface extends for only up to about 120° or less, more preferably about 90°, around the top of the hoop. Preferably the surface is arranged symmetrically with respect to the vertical centre-line of the hoop.

The hoop is preferably arcuate, most preferably circular in cross section, with the planar surface extending tangentially from the contact surface of the hoop in a direction parallel to the plane of the hoop. The hoop need not be circular in section, but preferably it has an arcuate surface for engaging the club. The contact surface could, for example, be a semi-circular surface.

The planar surface need extend outwardly from the hoop only so far as is needed to provide sufficient guidance for the club. This may be determined empirically, but in the case of a 6 ft (1.8 m) diameter hoop the planar surface may typically extend for a maximum distance of about 18" (0.5 m). The planar surface should not, however, extend so far that if it is being used with conventional clubs it interferes with the head of the club, thereby moving the club head out of plane.

Preferably the radial depth of the planar surface increases from the edges thereof. In the preferred embodiment, the depth is zero at the edges of the surface, which enables a smooth movement of the club onto the surface. Most preferably the depth increases to a maximum on the centre-line of the hoop, and the surface is symmetrical therearound.

In the most preferred embodiment, the outer edge of the surface is curved so that the surface resembles a crescent.

The planar surface may, for example, be defined between co-planar radially inner and outer surfaces, constituted for example by the hoop and a rail extending around the top of the hoop. A potential disadvantage of this arrangement is that a club may fall down between the defining surfaces, so preferably the planar surface is substantially solid. The surface may, therefore, be formed as an integral part of the hoop, e.g. it may be integrally moulded with a plastics hoop, or it may be formed on a separate component which is affixed to the hoop either permanently or removable by suitable fixing means, e.g. by welding.

As stated above, in use the hoop is inclined to the horizontal. Preferably the inclination of the hoop is variable so as to permit the optimum swing plane to be set for every user. The variation in inclination may be achieved in any suitable manner. For example opposed sides of the hoop may be mounted on respective supports, so as to be pivotable around the horizontal centre-line of the hoop. Preferably, however, the hoop is pivotably mounted at its lower end so that the lower end of the hoop remains in a generally fixed position relative to the ground.

The inclination of the hoop may be achieved manually, for example by loosening appropriate fixing means and rotating the hoop by hand. In an alternative arrangement, however, the inclination can be varied pneumatically or hydraulically by a suitable piston arrangement. In a simple embodiment, a hydraulic mechanism may be foot operated.

The hoop may be mounted on a base having a suitable standing surface for a user, for example one covered in astroturf, to simulate a golf tee. The base may also act to accommodate any power mechanism for inclining the hoop.

Ideally, the inclination of the hoop should be set for each individual, for example by a coach who can stand to one side of the hoop and align the hoop in the optimum swing plane for the user. However, this plane will vary from user to user, and it may not always be possible to set the inclination to an individual's precise requirements. In such a case, the hoop may for example be provided with a plurality of predetermined inclination settings and the particular inclination for a particular user based, for example, on height and arm length, be determined empirically and suitably displayed with the apparatus, so that the inclination can then be set to the empirically determined value by the user.

The apparatus described so far may be used with a simple golf club, for example. However, this is not preferred as it may cause damage to the club as it slides over the hoop surface. To alleviate this problem the hoop and/or the club may be provided with a low friction coating such as PTFE. The club could also be provided with a low friction sleeve e.g. of plastics such as PTFE, which fits over the club shaft.

Preferably, however, a custom practice club is used with the apparatus to avoid damage to a playing club. The practice club could, for example, comprise just a shaft having a grip and with a friction reducing sleeve arranged around it. In broad terms, therefore, the invention also provides a club for use in swinging over an inclined hoop comprising means provided on the shaft of the club for reducing friction with the hoop.

Preferably, however, a sleeve is rotatably mounted on the club shaft whereby as the club is moved over the hoop the sleeve can rotate about the shaft, thereby allowing the club to roll, rather than slide, over the hoop. This acts greatly to reduce friction with the hoop in use, and produces a much more satisfactory swing. This is in itself a novel arrangement, and from a further aspect the invention provides a golf training club comprising a shaft with a grip at one end and a sleeve rotatably mounted about the shaft.

Preferably rolling bearings such as ball bearings or roller bearings may be provided at appropriate locations between the shaft and the sleeve. In a simple embodiment, a bearing may be provided at each end of the sleeve, although additional bearings may be provided at intermediate locations along the sleeve, if required.

The sleeve preferably has a surface which promotes rolling of the sleeve on the hoop, for example a surface made of a resilient material such as rubber. The sleeve could be made entirely of that material, but preferably it comprises a metallic, e.g. a steel tube provided with an appropriate facing. The use of a metallic substrate is advantageous in that it lends rigidity to the sleeve, and also adds weight to the club. This is important in that it means that the club can be made significantly heavier than a normal club. This is potentially advantageous in that apart from acting to improve the golfer's swing it can act to exercise the golfer. In particular, the apparatus of the invention can provide a cardiovascular work out for a user as well as building "golfing" muscle in the appropriate body locations and promoting muscular flexibility.

A training club for use in apparatus in accordance with the invention may also be provided with means which limits the rotation of the forearms and causes the wrists to hinge in the optimum plane at the top of the backswing, and the follow through. This is advantageous in that it promotes an optimum blend of hand, wrist, forearm and body movements.

Preferably the limiting means comprises a planar surface provided on the club which will engage with the planar surface extending from the hoop at the top of the backswing and preferably also on the follow through. Most preferably, therefore, the club comprises two limiting surfaces, one for the backswing and one for the follow through. This is in itself a novel arrangement so from a further aspect the invention provides a golf practice club comprising a shaft having a grip at one end, having at least one and preferably two axially extending planar surfaces mounted to or provided on a portion of the length of the shaft.

These surface may advantageously be provided on a fin formed integrally with, or mounted to, the club shaft in such a way that it does not rotate relative to the shaft. The fin could, for example, be moulded onto the shaft.

Preferably, the planar surfaces on the club are arranged parallel to each other, and they may be joined at their leading edges by an circularly arcuate section which normally engages the hoop.

The fin may be made from or coated with a low friction material, but the 'finned' club arrangement is preferably combined with the rolling sleeve arrangement discussed above. Thus in a particularly preferred arrangement, the fin is mounted to a fixed shaft of the club around which is mounted a rolling sleeve.

It will be appreciated that the invention also extends to a combination of the hoop apparatus and training clubs as described above.

Some preferred embodiments of the invention will now be described by way of example only with reference to the accompanying drawings in which:

FIG. 1 shows a golfer addressing a golf ball;

FIG. 2 shows a golfer at the top of the backswing;

FIG. 3 shows a perspective view of apparatus embodying the invention;

FIGS. 11A–11G show different phases of a swing using apparatus of the invention, viewed from face on.

Figure 4:
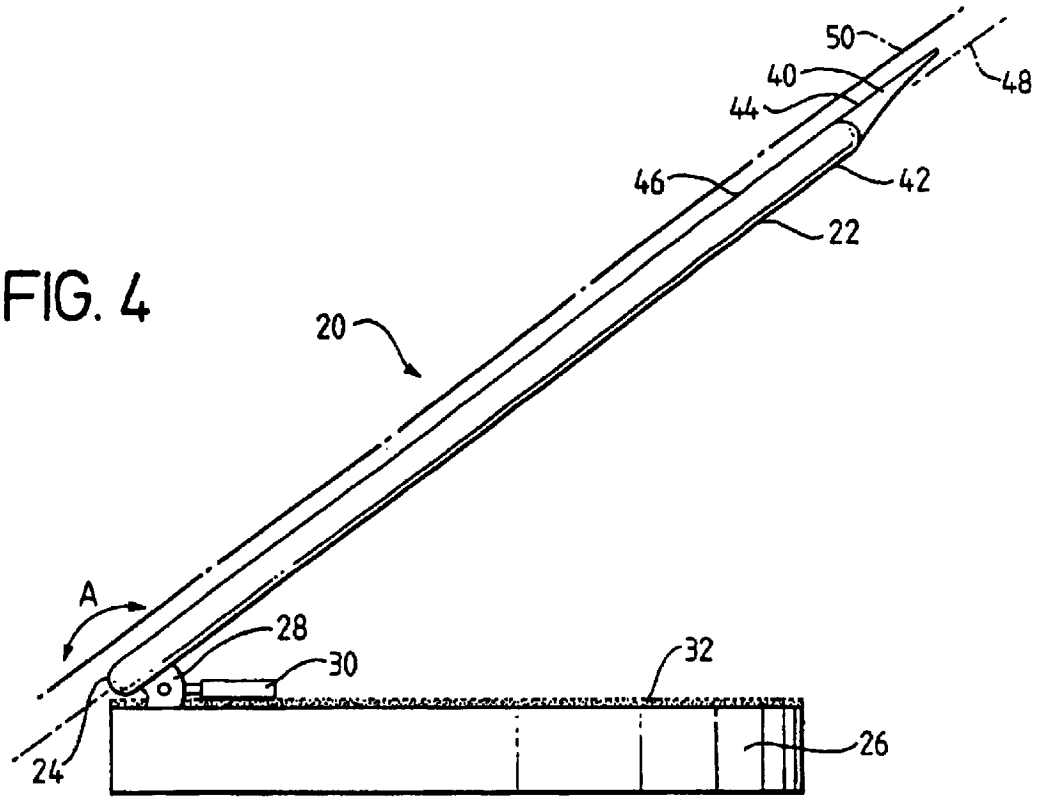
FIG. 4 shows a side elevation of the apparatus of FIG. 3.

With reference to FIGS. 1 and 2, FIG. 1 shows a golfer 2 addressing a ball 4. When addressing the ball correctly, the golfer's feet 6 should be aimed parallel to the target line (the line extending between the ball 4 and the target). It will be seen that a plane 8 extends through the target line, through the ball 4 and through the golfer's upper sternum 10. The Applicant believes that this is the optimum swing plane for a golfer. The Applicant believes that the sternum 10 of the golfer, the butt 12 of the golf club 13 and the sweet spot 14 of the club head should all lie in the plane 8 when, as shown in FIG. 2, the golfer is at the top of the backswing and ideally also, at follow through.

An apparatus embodying the invention which helps achieve the above objective is shown in FIGS. 3 and 4. The apparatus 20 comprises a hoop 22 which is pivotally mounted at its lower end 24 to a base 26 the hoop 22 is circular in shape and may typically have a diameter of 6 feet (1.83 meters). In this embodiment, the hoop 22 is made of steel tube of 3" (75 mm) diameter. However, the hoop may be made of other materials and may not necessarily be hollow. For example, a lightweight hoop could be made from plastics or other similar material.

The hoop 22 is provided with a bracket 28 at its lower end 24. The bracket 28 is attached to hydraulic means (not shown) within the base 26 which are operable by a foot lever 30 whereby the bracket may be pivoted in the directions indicated by arrow A on FIG. 4 so as to vary the inclination of the hoop 22 from the horizontal. The base 26 may be provided with a surface 32 of astroturf or the like for simulating a grass surface.

Attached to the upper end of the hoop 22 is a fin 40. The fin 40 is, in this embodiment, a separate component which is suitably attached e.g. by welding, to the hoop 22 around the upper end 42 of the hoop. As can be seen from FIG. 3, the fin 40 is generally crescent shaped and it extends symmetrically for approximately 120° around the upper end of the hoop 22.

As can be seen most clearly from FIG. 4, the fin 40 has an upper planar surface 44 which lies flush with the uppermost surface 46 of the hoop 22 and which extends parallel to the axis 48 of the hoop 22. Thus the planar surface 44 effectively constitutes a planar extension of the upper surface 46 of the hoop around the upper end 42 of the hoop.

As will be described in greater detail below, in use, a golfer will stand inside the hoop 22 and rest a club on the surface 46 of the hoop 22 and then swing the club in contact with that surface 46. This constrains the club shaft to follow the surface 46 of the ring 22. Furthermore, when the club 13 is at the top of the backswing or at the follow through, then the club will also engage the planar surface 44 of the fin 40 such that the butt of the club, the sweet spot and the sternum lie in a plane 50 defined parallel to the plane of the hoop 22. In this way, the club is maintained in the swing plane at these crucial parts of the swing.

This constraint is not required at other parts of the swing since each individual has a particular swing style which means that it is in fact desirable to allow variation in the angle of the club shaft relative to the surface 46 as the club descends from the top of the backswing towards the striking point.

Figure 5:
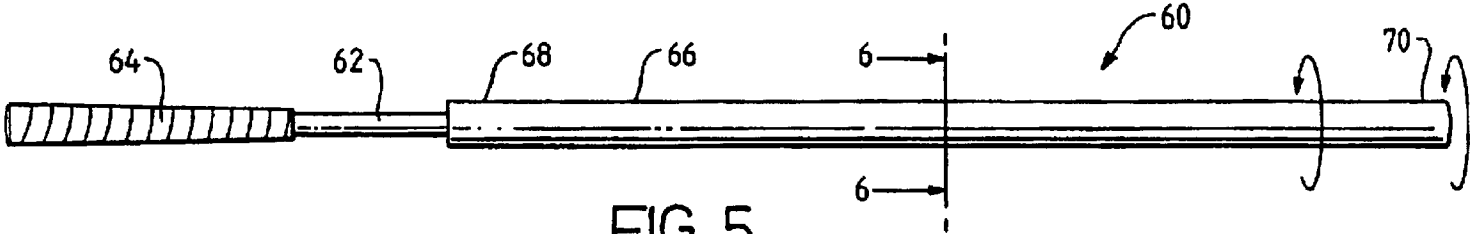
FIG. 5 shows a training club for use with the apparatus shown in FIGS. 3 and 4.

Whilst it may be possible to use a conventional club with the apparatus described above, it is, however, preferred to use a customised training club. A first embodiment of such a club is shown in FIG. 5.

This club 60 comprises a shaft 62 having a grip 64 provided on its proximal end and a rubber sleeve 66 provided extending over the major part of its length towards its distal end. The sleeve 66 is rotatably mounted on the shaft 62 by bearings (not shown) at its respective ends 68, 70 whereby the sleeve may effectively roll over the shaft surface. As shown the sleeve is of solid rubber, but it may, in fact, comprise a metal, e.g. steel, sleeve 72 (shown in dotted lines in FIG. 6) having a rubber coating. The advantage of this arrangement is that it adds rigidity to the club, provides improved support for the bearings and it adds weight to the training club 60.

By virtue of the rubber surface of the training club and its bearing mounting, it will be appreciated that when the club 60 is placed in contact with the surface 46 of the hoop 22, and swung around the hoop 22 it will roll over the hoop surface 46 rather than slide. This will produce a much smoother action and will also reduce the possibility of damage to the ring surface 46.

The practice club 60 is preferably heavier than a standard club so that the user of the apparatus will be effectively exercising whilst using the apparatus which will not only give cardio-vascular benefits but also help to build and improve muscle in the appropriate areas for the swing.

Figure 7:
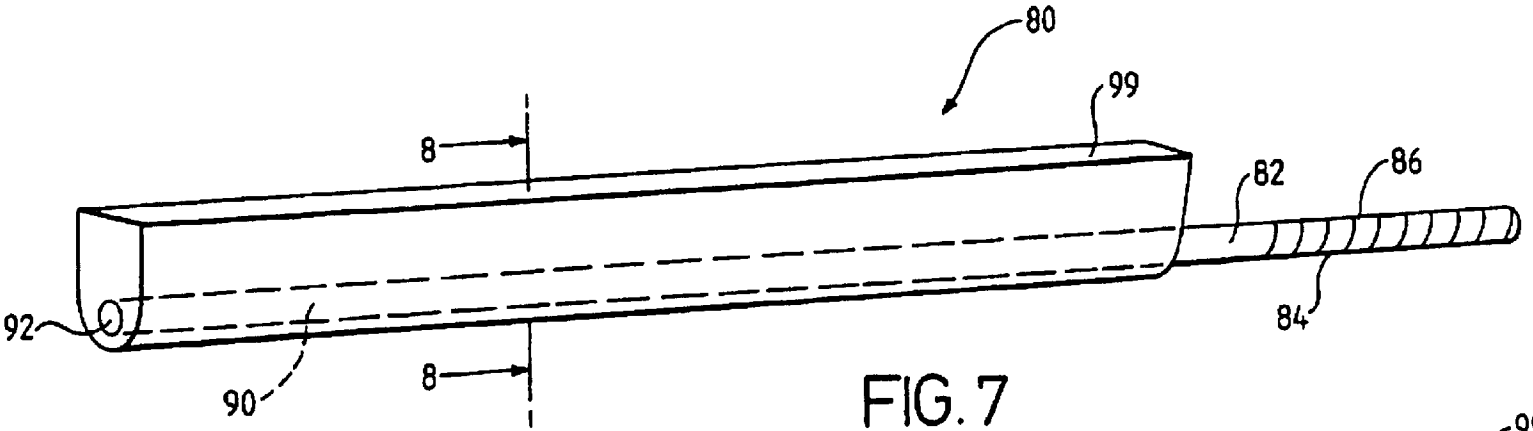
FIG. 7 shows a second embodiment of a training club for use with the apparatus of FIGS. 3 and 4.
Figure 8:
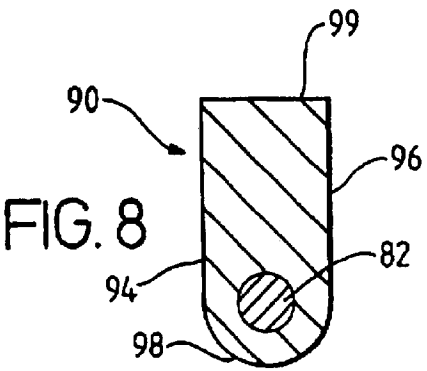
FIG. 8 is a section along line 8—8 of FIG. 7.

A second embodiment of club suitable for use with the invention is shown in FIGS. 7 and 8. In this embodiment, a club 80 comprises a shaft 82 on whose distal end 84 is provided a grip 86. A generally teardrop shaped sleeve 90 extends over the distal end 92 of the shaft 82. The sleeve 90 may be a separate component, suitably attached to the shaft 82 or, for example be integrally formed with the shaft, for example by insert moulding with the shaft 82.

The sleeve 90 is, therefore, preferably of plastics and, most preferably of a low friction plastic such as PTFE so as to reduce friction with the ring 22 in use. As can be seen best from FIG. 8, the sleeve 90 comprises two planar surfaces 94 and 96 which are parallel to each other and extend tangentially rearwardly from the semi-circular section nose 98 of the sleeve 90. Upon addressing the ball the trailing edge 99 of the sleeve 90 should be pointing away from the golfer's body. The advantage of the planar surfaces 94, 96 is that in use, when the golfer approaches the top of the backswing the surface 94 will come into contact with the planar surface 44 on the fin 40. This will give an audible indication that the club 80 is in the upper most part of the backswing. Furthermore, it will also prevent the further rotation of the club shaft relative to the fin 40 so as to maintain the user's forearms in the correct position for optimum swing.

After the stroke has taken place and the follow through occurs then the opposite surface 96 of the sleeve 90 will come into contact with the fin 40 again preventing over-rotation of the golfer's forearms.

Figure 9:
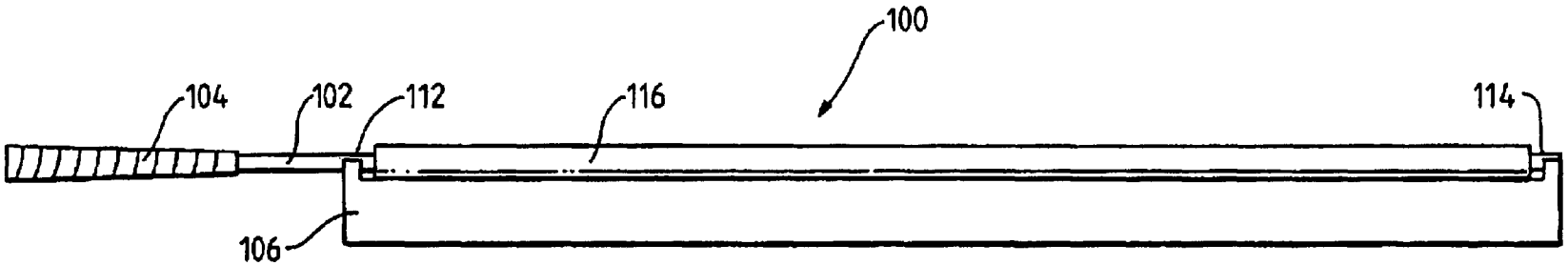
FIG. 9 shows a third embodiment of a training club for use with the apparatus of FIGS. 3 and 4.
Figure 10:
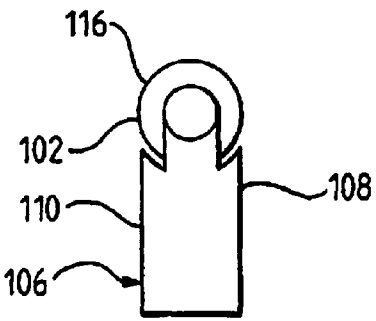
FIG. 10 is an end view of the training club of FIG. 9.

A third embodiment of training club for use with the apparatus FIGS. 3 and 4 is disclosed in FIGS. 9 and 10. In fact, the club 100 of this embodiment is a hybrid of the clubs of FIGS. 5 to 8. In particular, the club 100 comprises a shaft 102 having a grip 104 provided at its proximal end. A fin 106 having parallel planar surfaces 108 and 110 is fixedly attached to the shaft 102 at its respective ends 112, 114. Accordingly, there can be no relative movement between the shaft 102 and the fin 106. However, a rolling sleeve 116 is also mounted on the shaft 102, in a manner similar to that in the embodiment of FIGS. 5 and 6. Thus the sleeve 116 may rotate on the shaft 102 so that in use, the club can roll over the hoop surface 46 and at the same time the fin surfaces 108, 110 still come into contact with the fin surface 44 at the top of the backswing and in the follow through.

Figure 11:
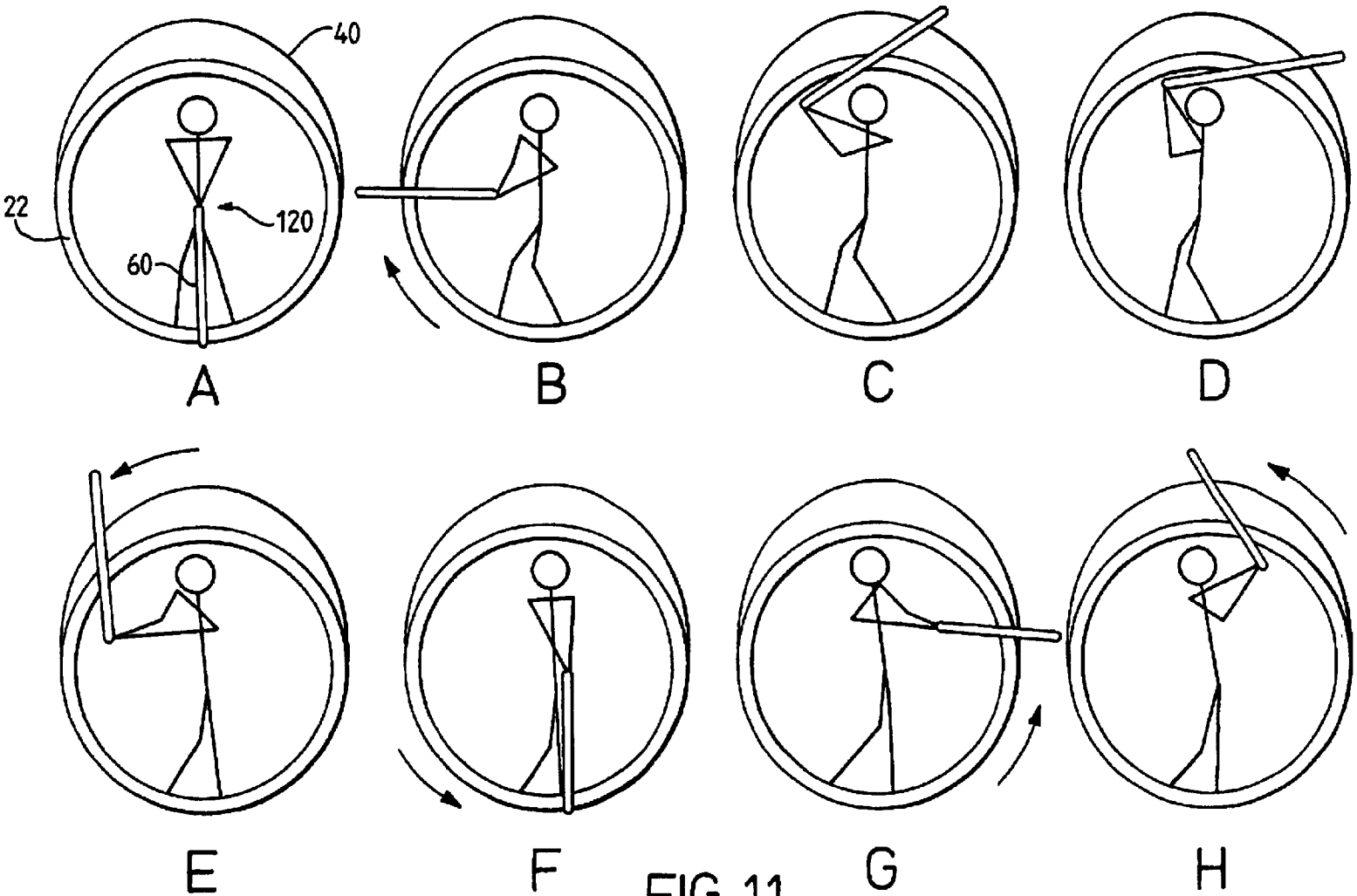
Figure 12:
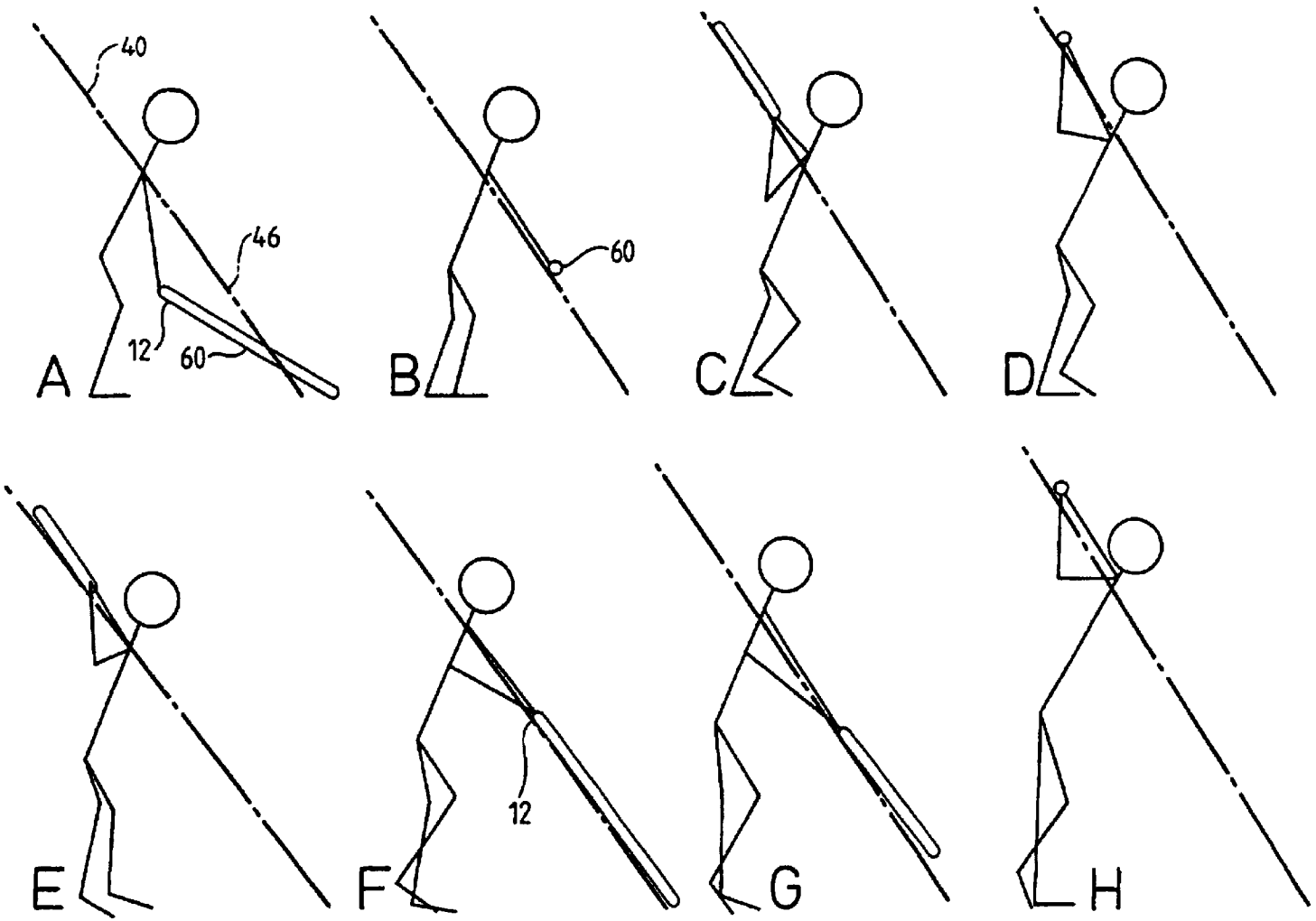
FIGS. 12A–12G show the same phases of a swing, viewed from the side.

The execution of a swing using apparatus in accordance with the invention will now be explained with reference to FIGS. 11 and 12 which show different phases in a swing being made using apparatus in accordance with the invention.

Figure 6:
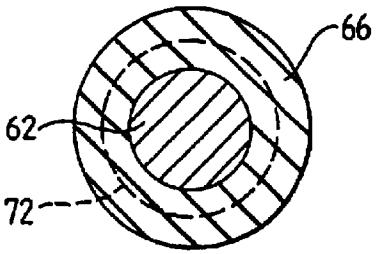
FIG. 6 shows a sectional view on line 6—6 of FIG. 5.

In FIGS. 11A and 12A, the golfer 120 using a roller club 60 as shown in FIGS. 5 and 6 takes stance in the middle of the hoop 22 with the roller 66 of the club 60 resting on the hoop 22. The golfer's feet are aligned parallel to the target line.

FIGS. 11B and 12B show a golfer half way through the backswing. In moving from the position shown in FIGS. 11A and 12A to that shown in FIGS. 11B and 12B, the roller 66 of the club 60 rolls over the surface 46 of the hoop 22. As can be seen, the golfer has turned his shoulders and upper body to initiate the swing.

In FIGS. 11C and 12C, the golfer is approaching the top of the backswing. The golfer's forearms are obliged to roll as the shoulder and body turn continues and as shown in FIG. 12C, the golfer's weight is transferred to the right foot. The roller 66 has also now moved onto the planar surface 44.

In FIGS. 11D and 12D, the golfer has now reached the top of the backswing. In this position the golfer's wrists are hinged through 90° from their rest position and the roller 66 of the club 60 is now lying flat on the planar surface 44 of the fin 40. At this position the golfer's sternum, the butt of the club and the distal end of the club are all lying in a plane which lies parallel to the surface of the hoop 22. This corresponds to the optimal swing plane. The planar surface 44 of the fin 40 ensures that hinging of the golfer's wrist occurs in the optimal plane during this part of the swing.

In FIGS. 11E and 12E, the golfer has commenced the downswing and his body weight shifts to his left leg. The roller has moved along the fin 40 and rejoins the hoop surface 46.

FIGS. 11F and 12F, show the impact position. As can be seen, although the sweetspot of the club and the golfer's upper sternum lie in the optimal plane, the whole club does not, and the butt of the club lies below the plane. This is not of particular importance, and the actual position of the butt of the club will depend upon the individual golfer's swing. The momentum of the rolling club will carry the player on through the impact position.

FIGS. 11G and 12G show a follow through position in which the player's weight has moved even more onto the left foot, the hands and forearms roll over each other and a wide arch is encouraged by the clubs rolling momentum. The roller 66 of the club 60 still maintains contact with the surface 46 of the hoop 22.

Finally, FIGS. 11H and 12H show the end of the swing, with the golfer in a full follow through position. It is in some respects a mirror of the position shown in FIGS. 11D and 12D. In this position, the roller 66 of the club 60 again lies flat on the fin 40 such that the club head, butt and the golfer's upper body lie in the optimal swing plane.

In use, the golfer would build a swing slowly from the rest position shown in FIGS. 11A and 12A to a full swing. In particular, in a warm-up the golfer may only swing through the bottom half of the hoop 22, slowly building towards a full swing. It will be appreciated that the equipment will not only improve the golfer's swing but would also be a useful form of exercise, particularly when the club 60 being used is weighted so as to be heavier than a normal club.

It will be appreciated that the above described embodiments are given by way of example only and that various modifications thereto may be made without departing from the scope of the invention. For example, the rolling sleeve 66 of the clubs shown in FIGS. 5 and 9 may be made of any suitable material which will allow a rolling engagement with the ring surface 46. Rubber is given as merely one suitable example and others will be apparent to the skilled person. Furthermore, the fin 44 which is shown as a separate component in FIGS. 3 and 4 need not necessarily be so and it would be possible, for example, to form this integrally with the hoop 22. Furthermore, the hoop itself can be of some other material than metal, for example plastics and indeed this may be desirable in a low cost application, such as one as may be used at home. Also, the hoop 22 need not be a circular section tube, but could have other sections, for example a D section.

It will also be appreciated that the ring may be supported by means other than those specifically shown, for example by supports at opposed sides thereof. Furthermore, although a hydraulically operated mechanism is disclosed for varying the angle of inclination of the hoop 22, it is anticipated that this could be done, for example manually, in less expensive versions of the apparatus, or even through other means such as electric motors.

It is anticipated that the invention may be applied in several areas. For example, it could very usefully be installed at golf clubs and driving ranges where a user may practice a swing before playing a game or before hitting some practice balls. However, it is equally anticipated that the equipment could be installed, for example, in health clubs and such like where users may not only take the opportunity to improve their golfing swing but also exercise using the equipment.

It will be clear that the equipment in accordance with the invention can be provided with ancillary equipment such as video camera means which will allow a user to analyse his or her action during use of the equipment, audio visual means to give information to users on how to use the equipment, and setting tables giving information which allows the hoop to be set at the appropriate angle for a user depending on his or her height, arm length and so on.

All such arrangements are intended to fall within the scope of the invention.

What is claimed is:

1. A golf training aid comprising a circular hoop inclined or inclinable in use at an angle to the horizontal, and moans defining a planar surface extending outwardly for a limited circumferential extent from the surface of the upper end of the hoop in a direction parallel to the plane of the hoop.

2. A golf training aid as claimed in claim 1 wherein the planar surface extends for only up to about 120° around the top of the hoop.

3. A golf training aid as claimed in claim 1 wherein the planar surface extends for about 90° around the top of the hoop.

4. A golf training aid as claimed in claim 1 wherein the planar surface is arranged symmetrically with respect to the vertical centre-line of the hoop.

5. A golf training aid as claimed in claim 1 wherein the hoop is at least partially circular in cross section.

6. A golf training aid as claimed in claim 1 wherein the radial depth of the planar surface increases from the edges thereof.

7. A golf training aid as claimed in claim 6 wherein the depth is zero at the edges of the surface and increases to a maximum around the centre-line of the hoop.

8. A golf training aid as claimed in claim 7 wherein the planar surface is crescent shaped.

9. A golf training aid as claimed in clam 1 wherein the planar surface is defined between co-planar radially inner and outer surfaces.

10. A golf training aid as claimed in claim 1 wherein the planar surface is solid.

11. A golf training aid as claimed in claim 10 wherein the planar surface is formed as an integral part of the hoop.

12. A golf training aid as claimed in claim 10 wherein the planar surface is formed on a component which is affixed to the hoop.

13. A golf training aid as claimed in claim 1 wherein the inclination of the hoop is variable.

14. A golf training aid as claimed in claim 13 wherein the hoop is pivotably mounted at its lower end.

15. A golf training aid as claimed in claim 1 further comprising a base having a standing surface for a user to which the base the hoop is mounted.

16. A golf training aid as claimed in claim 1 further comprising a club.

17. A golf training aid as claimed in claim 16 wherein one of the group selected from the hoop surface and the club is provided with a low friction coating such as PTFE.

18. A golf training aid as claimed in claim 17 wherein the club is provided with a low friction sleeve around the shaft thereof.

19. A golf training aid as claimed in claim 16 wherein a sleeve is rolatably mounted on the club shaft.

20. A golf training aid as claimed in claim 19 wherein the rolling surface of the club is of a material which promotes rolling of the alcove on a or the hoop.

21. A golf training aid as claimed in claim 19 wherein the sleeve comprises a metallic tube provided with a rolling material facing.

22. A golf training aid as claimed in claim 19 wherein the club comprises a planar surface extending axially along and radially outwardly of the club shaft.

23. A golf training aid as claimed in claim 22 comprising a pair of parallel planar surfaces.

24. A golf training aid as claimed in claim 23 wherein said surfaces are provided on a fin formed integrally with, or mounted to, the club shaft.

25. A golf training aid as claimed in claim 24 wherein the fin is mounted to a fixed shaft of the club around which is mounted a rolling sleeve.

26. A golf training aid comprising a hoop inclined or inclinable in use at an angle to the horizontal and over whose surface a club may be swung, said hoop comprising means which extend for only a limited circumferential extent around the hoop and which guides the club to move in a given plane at the top of the swing.

27. A golf training aid as claimed in claim 26 wherein said means comprises a fin extending around the upper part of the hoop.

* * * * *